US005135040A

United States Patent [19]

Ruiter

[11] Patent Number: 5,135,040

[45] Date of Patent: Aug. 4, 1992

[54] DOOR ASSEMBLY WITH A FLEXIBLE DOOR PANEL

[75] Inventor: Marc A. Ruiter, Amersfoort, Netherlands

[73] Assignee: Polynorm N.V., Bunschoten, Netherlands

[21] Appl. No.: 581,383

[22] Filed: Sep. 12, 1990

Related U.S. Application Data

[63] Continuation-in-part of Ser. No. 435,972, Nov. 14, 1989, Pat. No. 5,042,556.

[30] Foreign Application Priority Data

Dec. 1, 1988 [NL] Netherlands ..... 8802968

[51] Int. Cl.[5] ..... E05D 15/06

[52] U.S. Cl. ..... 160/201; 160/191

[58] Field of Search ..... 160/189, 201, 191, 188, 160/192, 133

[56] References Cited

U.S. PATENT DOCUMENTS

| | | | |
|---|---|---|---|
| 1,936,300 | 11/1933 | Guss | 160/188 X |
| 2,846,254 | 8/1958 | Forest . | |
| 2,850,088 | 9/1958 | Purdy | 160/201 X |
| 2,914,775 | 12/1959 | Kauffman | 160/201 X |
| 2,926,727 | 3/1960 | Purdy | 160/189 |
| 2,947,354 | 8/1960 | Nectoux . | |
| 3,017,218 | 1/1962 | Groth et al. | 160/201 X |
| 3,129,752 | 4/1964 | Whiting . | |
| 3,142,333 | 7/1964 | Kummerman et al. | 160/133 X |
| 3,532,153 | 10/1970 | D'Anka | 160/201 |
| 3,797,171 | 3/1974 | Farmer | 160/188 X |
| 4,219,067 | 8/1980 | Hurst . | |
| 4,717,196 | 1/1988 | Adams . | |
| 4,794,973 | 1/1989 | Perisic . | |
| 4,795,206 | 1/1989 | Adams . | |
| 4,807,687 | 2/1989 | Finch et al. | 160/133 |
| 4,811,777 | 3/1989 | Chretien . | |
| 4,930,563 | 6/1990 | Finch et al. | 160/133 X |
| 4,986,331 | 1/1991 | Henkenjohann | 160/201 |

*Primary Examiner*—David M. Purol

*Attorney, Agent, or Firm*—Christie, Parker & Hale

[57] ABSTRACT

Described herein is a door assembly that includes a flexible panel of flexible plate material which is guided in channels between a closed position to an opened position; the flexible panel assuming a substantially horizontal position in the open position and thereby increases the height clearance in the door opening.

8 Claims, 3 Drawing Sheets

DOOR ASSEMBLY WITH A FLEXIBLE DOOR PANEL

CROSS REFERENCE TO RELATED APPLICATION

This application is a continuation-in-part of U.S. Patent Application Ser. No. 435,972, filed Nov. 14,1989, the disclosure of which is incorporated herein by reference.

The invention relates to a door comprising a frame and a flexible panel which is movable relative to said frame between a vertical closing position and a horizontal opened position.

Such a door is known and is especially, but not exclusively, intended for closing garages. It can be of importance here that in the opened position the door provides the greates possible height clearance in order, for example, to allow passage of the highest possible vehicle.

SUMMARY OF THE INVENTION

The invention has for its object to enlarge the height clearance in the opened position and to operate the door without problem.

The door assembly according to a preferred embodiment comprises a frame and a flexible panel which is movable relative to said frame between a closed position and an opened position; said frame comprising at each of both sides of the flexible panel vertical guide means defining a door opening therebetween; horizontal guide means connected to the top end of said vertical guide means; bend guide means arranged between said vertical guide means and said horizontal guide means; said vertical guide means, horizontal guide means and bend guide means engaging side edges of said flexible panel; said horizontal guide means comprising a profiled member at a first channel facing the flexible panel and receiving a side edge thereof, said member being bounded by a second channel for receiving a draw spring for balancing the weight of the flexible panel

BRIEF DESCRIPTION OF THE DRAWINGS

The invention will be elucidated in the description following hereinafter with reference to the drawings. In the drawings.

DESCRIPTION OF PREFERRED EMBODIMENT

Figure 1:
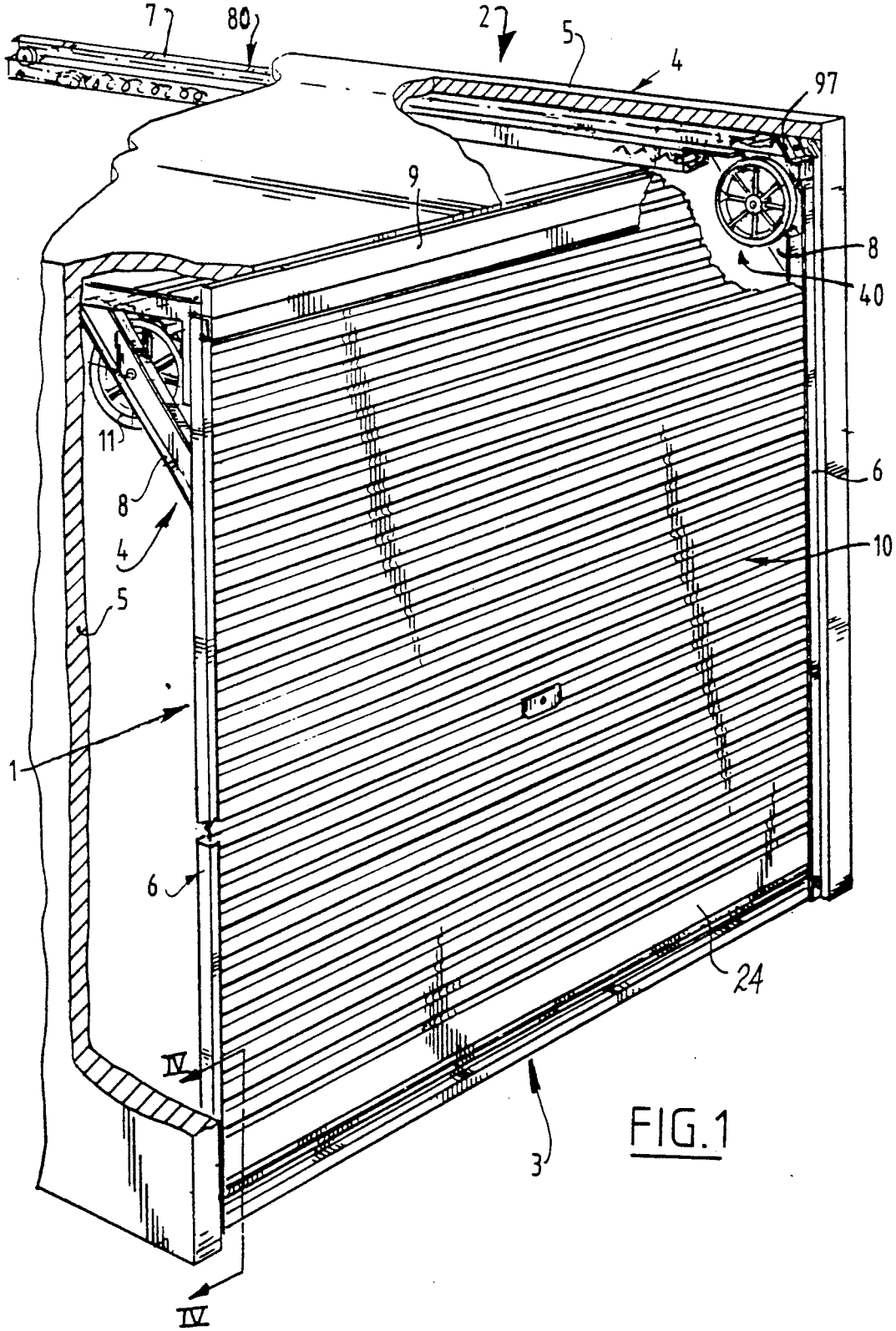
FIG. 1 is a partly broken away perspective view of a garage with a door in closed position.
Figure 2:
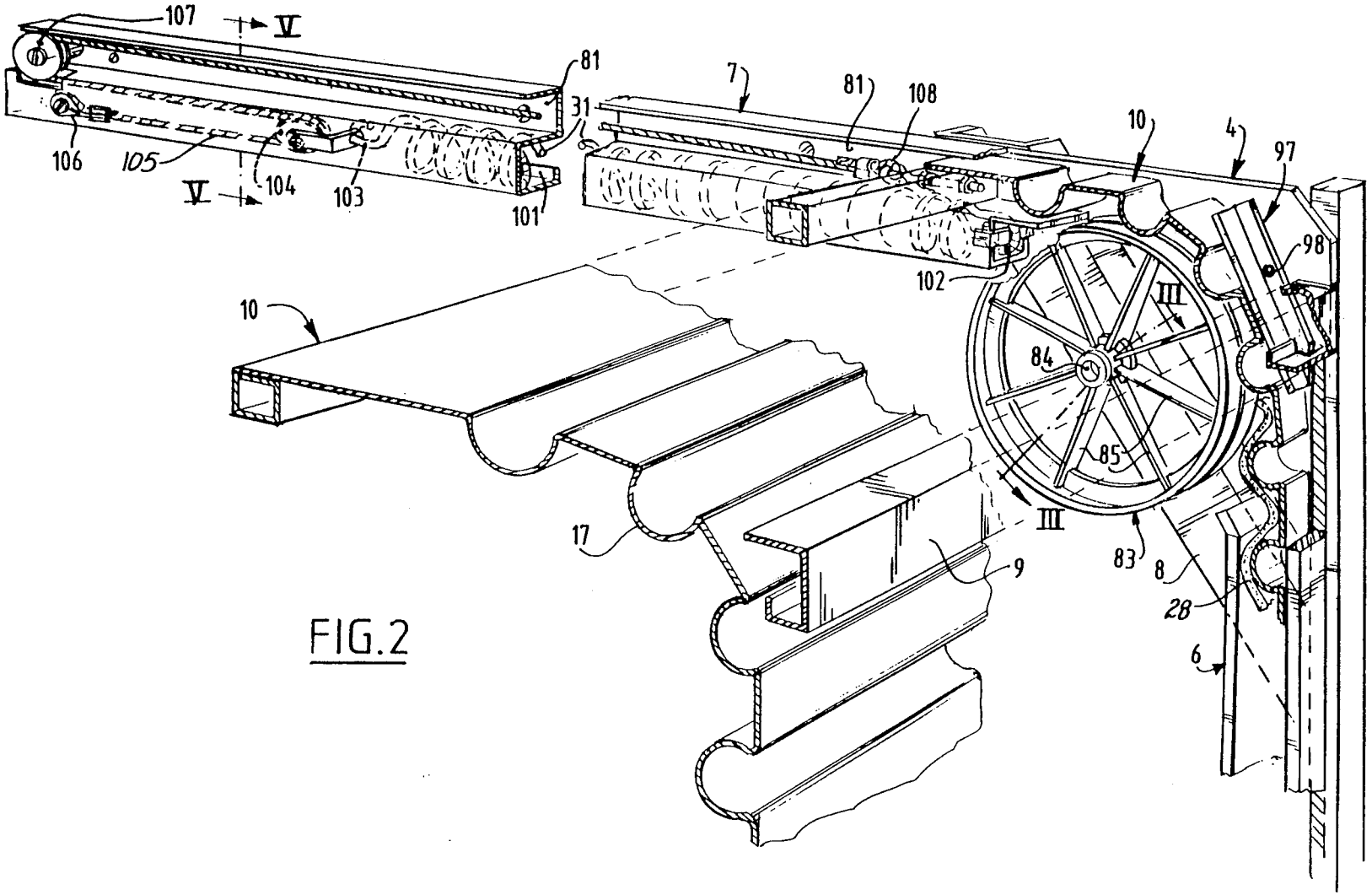
FIG. 2 a perspective view of a portion of FIG.1.
Figure 5:
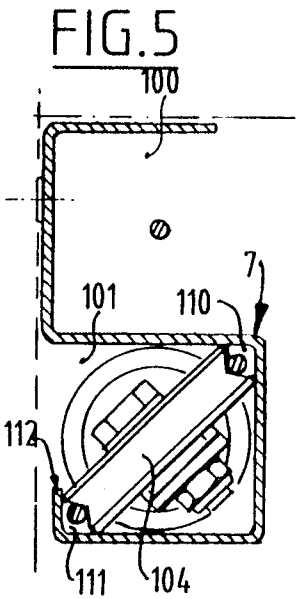
FIG. 5 is a section view along line V—V of FIG. 2.
Figure 4:
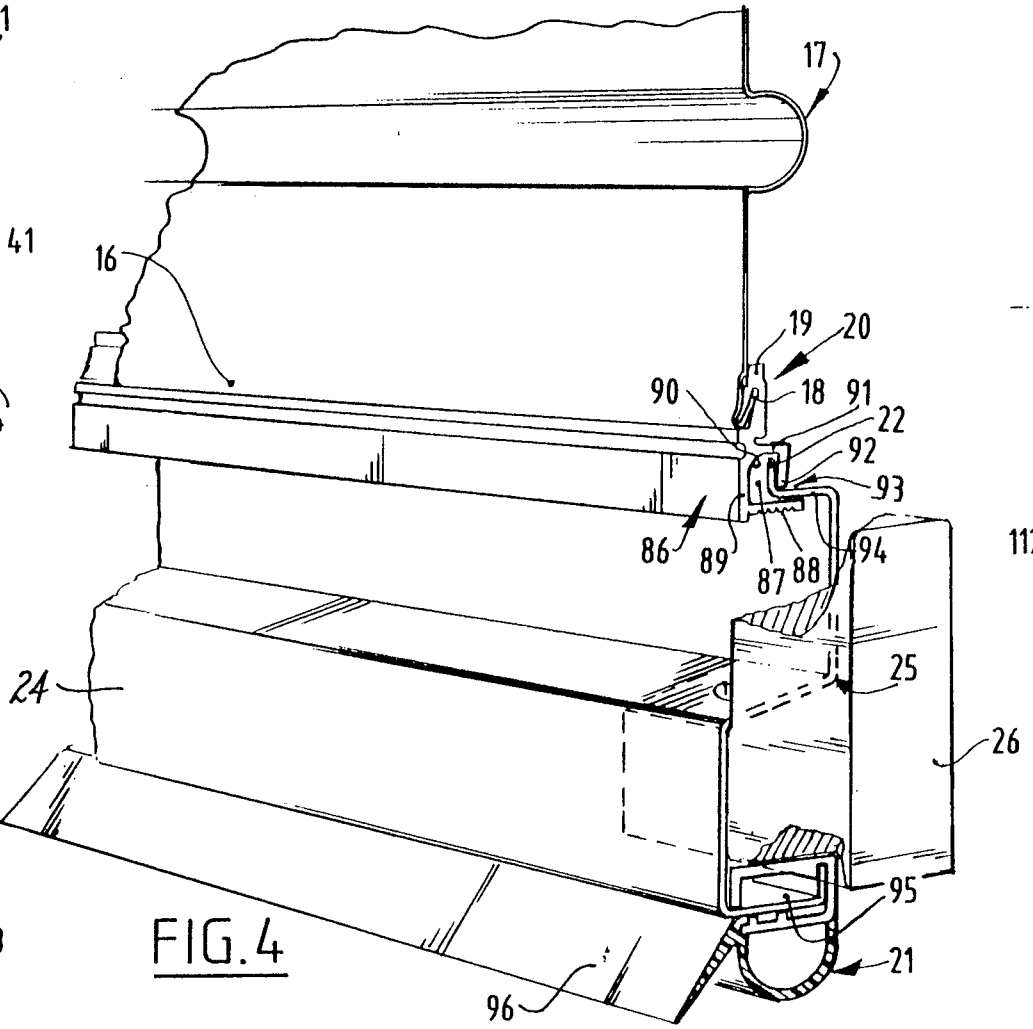
FIG. 4 is a perspective view along line IV—IV of FIG. 1.
Figure 3:
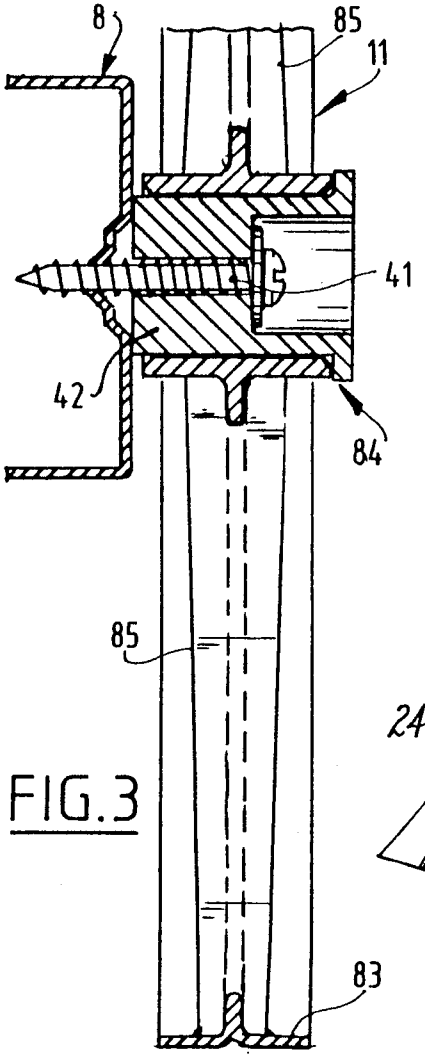
FIG. 3 is of the door assembly a section view along the line III—III in FIG. 2.

A door 1 according to the invention can be fitted as a prefabricated unit in the passage opening 3 of a garage 2; the unit has a frame 80 comprising side frames 4 which are fixed in a manner not shown to the side walls 5 of garage 2. Each side frame 4 consists of a vertical U-profile 6 and a horizontal S-profile 7 mutually joined by means of a brace 8. The side frames 4 are mutually connected by a buffer beam 9 which closes off the top of the passage opening 3. A flexible door panel 10 consisting of flexible steel plate material 17 having a thickness of for example, 0.5 mm is guided in the U-profiles 6 and guide channels 81 of the profiles 7. Door panel 10 is also guided behind the buffer beam 9, specifically at the location of the bend, by means of guide wheels 11 forming part of bend guide means 40, which are each mounted for rotation on a shaft 42 connected to brace 8 of frame 4 by means of a screw 41 of the self threaded tapeing kind. The screw 41 into the metal plate profile constituting the brace 8. The round and smooth periphery of the guide wheel 11 comes into contact with the side edge of the door panel 10 and while at this position the profiles 6 and 7 are recessed. The guide wheel 11 is made of synthetic resin and is constituted by a round ring 83, a hub 84 and spokes 85.

A horizontal bottom edge 16 of the flexible plate material 17 is bent over as an angle section 18 and is clamped fixedly into an angle section 19 of a profiled coupling element 20. The lower part 86 of said coupling element 20 bounds a coupling channel 87 by means of, successively, a horizontal bottom profile part 88, a first vertical profile part 89, a rounded part 90, a horizontal top profile part 91 and a second vertical part 92, which is spaced from said horizontal bottom part 88 for providing a passage 93 for a horizontal part 94 of a profiled stiffening beam 25. A vertically extending edge 22 is connected to horizontal part 94 of stiffening beam 25 and extends in closing position of the flexible door panel 10 vertically into coupling channel 87.

Guide blocks 26 provided at the side edges 24 of the stiffening beam 25 are received in the U-profiles 6. A hollow sealing profile 21 is connected to the bottom edge 95 of the stiffening beam 25 and has a rain water drip edge 96.

Each bend guide means 40 comprises above the guide wheel 11 a guide element 97 which is pivotably attached to a side frame 4 about a pivot axis 98.

As a result of the use of the stiffening beam 25 and the hinged attachment thereof to the horizontal edge 16 of the door panel 10, door panel 10 allows easy guiding out of the opened position and easy pulling into the closing position. Especially in combination with the rotatable guide wheel 11, the door panel 10 is easy to operate without the panel having the tendency to go out of square and/or become stuck. The stiffening beam 25 has on either end a guide block 26 of plastic and is rounded off at its front side and co-acts with the U-profiles 6 and with the guide element 97 for guiding. The door panel 10 has on its edges guide strips 28 of plastic which makes movement door noiseless.

The profiles 7 are S-shaped and bound a first channel 81 constituting a guide channel for the flexible panel 10 and receiving a side edge thereof and a second channel 101 accomodating a draw spring 31 for balancing the weight of the flexible panel 10. Said draw spring 31 is connected at its one end 102 to said side frame 4 in the vicinity of the guide wheel 11 and at its other end 103 to a movably pulley 104. Said movable pulley 104 engages a flexible draw member 105 such as a cable which extends from end 106 connected to said side frame 4 at the rear side of the garage 2 over said movable pulley 104 and over a fixed or stationnary pulley 107 mounted for rotation on side frame 104 at the rear side of the garage 2 to a connected member 108 connected to said flexible panel 10. The second channel 101 receives the movable pulley 104 in an inclined position wherein it extends between two opposed corners 110 and 111 of said profile S-shaped member 7. To

I claim:

1. A door assembly comprising:

a frame and a flexible panel which is movable relative to said frame between a closed position and an opened position;

said frame comprising at each of both sides of the flexible panel vertical guide means defining a door opening therebetween;

horizontal guide means connected to the top end of said vertical guide means;

bend guide means arranged between said vertical guide means and said horizontal guide means;

said vertical guide means, horizontal guide means and bend guide means engaging side edges of said flexible panel; said horizontal guide means comprising an S-shaped profiled member defining a first channel facing the flexible panel and receiving a side edge thereof, and further defining a second channel and a draw spring for balancing the weight of the flexible panel;

said draw spring being disposed within said second channel of said profiled member, and being connected at one end to said frame and at its other end to a movable pulley, said movable pulley engaging a flexible draw member and said flexible member extending from the end connected to said frame over said movable pulley and over a stationary pulley mounted for rotation on said frame to a connection member connected to said flexible panel.

2. A door assembly as claimed in claim 1, wherein said second channel receives the movable pulley in an inclined position wherein it extends between opposing corners of said profiled member.

3. A door assembly as claimed in claim 1, wherein said profiled member is S-shaped.

4. A door assembly as claimed in claim 1, wherein said shaft is made of synthetic resin.

5. A door assembly as claimed in claim 1, characterized in that said guide wheel is made of synthetic resin.

6. A door assembly according to claim 1 comprising:

a frame and one single flexible panel means which is movable relative to said frame between a closed position and an opened position, said frame comprising at each of both sides of the flexible panel vertical guide means defining a door opening therebetween, horizontal guide means connected to the top end of said vertical guide means and bend guide means arranged between said vertical guide means and said horizontal guide means;

said vertical guide means, said horizontal guide means and said bend guide means engaging side edges of said flexible panel;

said flexible panel comprising a shield of flexible plate material, a coupling element and a stiffening beam; the bottom edge of said shield being connected to said coupling element bounded by a coupling channel by means of, successively, a horizontal bottom profile part, a first vertical profile part, a rounded part, a horizontal top profile part and a second vertical part, said second vertical part being spaced from said horizontal bottom part for providing a passage for a horizontal part of said stiffening beam, a vertically extending edge being connected to said horizontal part of said stiffening beam, extending in the closed position of the flexible panel vertically into said coupling channel.

7. A garage door assembly according to claim 1 comprising one single flexible panel of flexible plate material, which is guided at each side by means of horizontal guide means, upright guide means and intermediate guide means extending therebetween, to guide said panel between an upright closed position and an extended horizontal opened position, said intermediate guide means comprising guide wheels, each guide wheel individually mounted in a corner between respective horizontal and upright guide means and a strengthening means pivotally coupled to a horizontal edge of said flexible panel.

8. A door assembly comprising:

a frame and a flexible panel comprising a plurality of plates of flexible material which is movable relative to said frame between a closed position and an opened position, said frame comprising at each of both sides of the flexible panel vertical guide means defining a door opening therebetween, horizontal guide means connected to the top end of said vertical guide means;

bend guide means arranged between said vertical guide means and said horizontal guide means, sliding means connected to both side edges of said flexible panel, said vertical guide means, horizontal guide means and bend guide means engaging said sliding means connected to said side edges of said flexible panel, said bend guide means comprising a guide wheel which is rotatably mounted on a shaft connected to said frame and a pivoting guide element mounted for pivoting movement on the frame and engaging the outer surface of a flexible panel edge engaging said guide wheel with its inner surface;

said guide wheel being made of synthetic resin and comprising a hub, a round ring having a smooth peripheral outer surface and a plurality of spokes connecting said ring with said hub.

* * * * *